US011221152B2

(12) United States Patent
Jeong et al.

(10) Patent No.: US 11,221,152 B2
(45) Date of Patent: Jan. 11, 2022

(54) DEHUMIDIFIER

(71) Applicant: LG ELECTRONICS INC., Seoul (KR)

(72) Inventors: Minwoo Jeong, Seoul (KR); Bongjun Kim, Seoul (KR); Sehyeon Kim, Seoul (KR); Jaeyoung Kim, Seoul (KR); Yohan Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 120 days.

(21) Appl. No.: 16/487,113

(22) PCT Filed: Feb. 12, 2018

(86) PCT No.: PCT/KR2018/001850
§ 371 (c)(1),
(2) Date: Aug. 20, 2019

(87) PCT Pub. No.: WO2018/151488
PCT Pub. Date: Aug. 23, 2018

(65) Prior Publication Data

US 2019/0376701 A1 Dec. 12, 2019

(30) Foreign Application Priority Data

Feb. 20, 2017 (KR) ..... 10-2017-0022297

(51) Int. Cl.
*F24F 3/153* (2006.01)
*F24F 3/14* (2006.01)
(Continued)

(52) U.S. Cl.
CPC ..... *F24F 3/153* (2013.01); *F24F 13/30* (2013.01); *F28D 15/02* (2013.01); *F28F 1/30* (2013.01); *F25B 2339/04* (2013.01)

(58) Field of Classification Search
CPC ..... F24F 2003/1452; F24F 2003/1446; F24F 1/0083; F24F 1/0358; F24F 3/153;
(Continued)

(56) References Cited

U.S. PATENT DOCUMENTS 2,090,208 A * 8/1937 Knudson ..... F28F 1/32 165/61
2,093,725 A * 9/1937 Hull ..... F24F 3/1405 62/93
(Continued)

FOREIGN PATENT DOCUMENTS

CH 657 692 9/1986
JP S59-180123 12/1984
(Continued)

OTHER PUBLICATIONS

Korean Notice of Allowance dated Feb. 26, 2020 issued in KR Application No. 10-2017-0022297.
(Continued)

*Primary Examiner* — Frantz F Jules
*Assistant Examiner* — Jason N Thompson
(74) *Attorney, Agent, or Firm* — Ked & Associates LLP

(57) ABSTRACT

A dehumidifier is provided. The dehumidifier may include a case having an air intake opening and an air discharge opening, an evaporator arranged inside the case and having evaporating fins coupled to evaporating tubes, a condenser arranged inside the case spaced apart from the evaporator, a fan that flows air in a direction from the evaporator to the condenser, and a heat pipe assembly positioned in front of and behind the evaporator in the air flow direction spaced apart from the evaporator. The heat pipe assembly may include heat pipes and heat-conducting fins each having a heat pipe coupling hole formed therein to be coupled to the respective heat pipe. Heat pipes may include heat-absorbing
(Continued)

pipe portions positioned in front of the evaporator, heat-dissipating pipe portions positioned between the evaporator and the condenser, and connecting pipe portions that connect the heat-absorbing pipe portion to the heat-dissipating pipe portion, respectively.

19 Claims, 4 Drawing Sheets

(51) Int. Cl.

| | |
|---|---|
| ***F24F 12/00*** | (2006.01) |
| ***F24F 13/30*** | (2006.01) |
| ***F28D 15/02*** | (2006.01) |
| ***F28F 1/30*** | (2006.01) |

(58) Field of Classification Search

CPC ..... F24F 2003/144; F24F 2012/005; F24F 2013/222; F28D 15/0266; F28F 1/24; F28F 1/30; F28F 1/32; F28F 17/005; F28F 2265/22

USPC ..... 62/176.5

See application file for complete search history.

(56) References Cited

U.S. PATENT DOCUMENTS

| | | | | |
|---|---|---|---|---|
| 5,309,725 | A * | 5/1994 | Cayce | F24F 3/1405 62/90 |
| 5,333,470 | A * | 8/1994 | Dinh | F24F 3/153 62/333 |
| 5,404,938 | A * | 4/1995 | Dinh | F24F 3/1405 165/113 |
| 6,006,998 | A * | 12/1999 | Rerolle | F24D 7/00 237/70 |
| 6,209,223 | B1 * | 4/2001 | Dinh | F26B 21/001 34/86 |
| 10,451,331 | B2 | 10/2019 | Shin et al. | |
| 2005/0000238 | A1 * | 1/2005 | Schmid | F25B 47/006 62/272 |
| 2005/0241812 | A1 * | 11/2005 | Malone | F28F 1/126 165/150 |
| 2008/0104974 | A1 * | 5/2008 | Dieckmann | F25B 40/00 62/93 |
| 2009/0126387 | A1 * | 5/2009 | Dinh | F24F 3/153 62/272 |
| 2011/0024087 | A1 * | 2/2011 | Lin | H01L 23/3672 165/104.26 |
| 2012/0186787 | A1 * | 7/2012 | Dinh | F28D 15/06 165/104.26 |
| 2013/0083482 | A1 | 4/2013 | Uchida et al. | |
| 2015/0082827 | A1 * | 3/2015 | Park | F24F 3/1405 62/426 |

FOREIGN PATENT DOCUMENTS

| | | | |
|---|---|---|---|
| JP | 09042871 | A * | 2/1997 |
| JP | 2013-072627 | | 4/2013 |
| KR | 10-1998-0010183 | | 4/1998 |
| KR | 10-0200055 | | 6/1999 |
| KR | 10-2013-0008864 | | 1/2013 |
| KR | 10-1409813 | | 6/2014 |
| KR | 10-1578532 | | 12/2015 |
| KR | 10-2016-0072642 | | 6/2016 |
| WO | WO 94/11687 | | 5/1994 |

OTHER PUBLICATIONS

International Search Report (with English Translation) and Written Opinion dated Jun. 14, 2018 issued in Application No. PCT/KR2018/001850.

European Search Report dated Nov. 30, 2020 issued in EP Application No. 18754133.9.

* cited by examiner

DEHUMIDIFIER

CROSS-REFERENCE TO RELATED PATENT APPLICATIONS

This application is a U.S. National Stage Application under 35 U.S.C. § 371 of PCT Application No. PCT/KR2018/001850, filed Feb. 12, 2018, which claims priority to Korean Patent Application No. 10-2017-0022297, filed Feb. 20, 2017, whose entire disclosures are hereby incorporated by reference.

TECHNICAL FIELD

The present disclosure relates to a dehumidifier, and more particularly, to a dehumidifier having a heat pipe disposed around an evaporator.

BACKGROUND

A dehumidifier, which is an air conditioner for lowering a humidity, may directly remove a moisture in an air to lower a relative humidity.

Schemes, by the dehumidifier, of removing the moisture in the air may be divided into a cooling scheme and a drying scheme.

A drying-type dehumidifier uses a moisture absorbent, which is a chemical material, that directly absorbs or adsorbs the moisture in the air, such as a dehumidification product used at home. When the moisture absorbent is no longer able to absorb the moisture, the moisture absorbent is heated again and the moisture is separated at this time. The separated moisture may be sent to out of the dehumidifier and again the moisture absorbent may be used. Such scheme is useful for removing a small amount of moisture in an enclosed space. The moisture absorbent includes silica gel, which is a porous material with an excellent ability to adsorb the moisture, and the like.

A cooling-type dehumidifier condenses water vapor in the air into water to regulate the moisture. In order to condense the water vapor, a temperature of the air should be lowered equal to or below a dew point. Thus, the cooling-type dehumidifier uses a refrigerant for cooling.

The cooling-type dehumidifier includes a compressor, a condenser, an expansion mechanism, and an evaporator, in which the refrigerant is circulated.

When the dehumidifier places a pre-cooling portion of a heat pipe (inlet-side heat pipe) in front of the evaporator in a flow direction of the air and places a heat-dissipating portion (outlet-side heat pipe) behind the evaporator, a load of the evaporator may be lowered and a power consumption of the compressor may be reduced.

An example of such the dehumidifier is disclosed in Korean Patent Laid-Open Publication No. 10-2013-0008864 A (published on Jan. 23, 2013). However, in the conventional dehumidifier as described above, an evaporation pipe and a horizontal heat pipe are connected together to a heat dissipation fin. Therefore, a total thickness of the evaporator is thick. Further, in a manufacture of various models considering a total thickness and power consumption of the dehumidifier, a thick evaporator with the horizontal heat pipe and a thin evaporator without the horizontal heat pipe should be separately manufactured. Thus, a total manufacturing cost for the manufacture of the dehumidifier is increased.

DISCLOSURE

Technical Purpose

A purpose of the present disclosure is to provide a dehumidifier that may allow a manufacturer to manufacture each of two models sharing the evaporator of a model with a large total thickness and a model with a small total thickness and reduce an overall manufacturing cost.

Technical Solution

An aspect of the present disclosure, there is provided a dehumidifier including: a case including a suction body having an air intake opening defined therein and a discharge body having an air discharge opening defined therein; an evaporator disposed inside the case, wherein the evaporator has an evaporating fin coupled to a evaporating tube; a condenser disposed inside the case, wherein the condenser is spaced apart from the evaporator; a fan flowing air from the evaporator to the condenser; and a heat pipe assembly positioned in front of and behind the evaporator in a flow direction of air, wherein the heat pipe assembly includes: at least one heat pipe having a heat-absorbing pipe portion in front of the evaporator in a flow direction of air and a heat-dissipating pipe portion between the evaporator and the condenser in the flow direction of air connected with each other by a conducting pipe portion; and at least one heat-conducting fin having a heat pipe coupling hole defined therein to which at least one of the heat-absorbing pipe portion and the heat-dissipating pipe portion is coupled.

In one embodiment, the heat-conducting fin may be spaced apart from the evaporating fin.

In one embodiment, the heat-conducting fin may be spaced apart from the evaporating fin in the flow direction of air and in a vertical direction.

In one embodiment, the number of the heat-conducting fins may be smaller than the number of the evaporating fins.

In one embodiment, the evaporating tube may include a plurality of evaporating tubes and the heat pipe includes a plurality of heat pipes. Further, a pitch of the heat pipes may be smaller than a pitch of the evaporating tubes.

In one embodiment, the heat-conducting fin may include: at least one front heat-conducting fin portion having a heat pipe coupling hole defined therein, wherein the heat-absorbing pipe portion is coupled to the heat pipe coupling hole; and at least one rear heat-conducting fin portion having a heat pipe coupling hole defined therein, wherein the heat-dissipating pipe portion is coupled to the heat pipe coupling hole.

In one embodiment, a distance between a rear-end of the front heat-conducting fin portion and a front-end of the rear heat-conducting fin portion may be larger than a width of the evaporating fin in the flow direction of air.

In one embodiment, the heat-conducting fin may further include a connecting fin portion connecting the front heat-conducting fin portion and the rear heat-conducting fin portion with each other, wherein the heat-conducting fin is integrally formed with the front heat-conducting fin portion and the rear heat-conducting fin portion.

In one embodiment, the connecting fin portion may be parallel to the connecting pipe portion.

In one embodiment, each of a width in a front and rear direction of the front heat-conducting fin portion and a width in the front and rear direction of the rear heat-conducting fin portion may be larger than a width in a vertical direction of the connecting fin portion.

In one embodiment, the connecting fin portion may further include: an upper fin portion positioned above the evaporator; and a lower fin portion positioned below the evaporator.

In one embodiment, an evaporator inserting space may be defined by the front heat-conducting fin portion, the rear heat-conducting fin portion, the upper fin portion, and the lower fin portion.

In one embodiment, the evaporator inserting space may be defined to be larger than the heat pipe coupling hole.

In one embodiment, the plurality of heat pipes may be vertically spaced apart from each other.

In one embodiment, a plurality of heat-absorbing pipe portions may be coupled to the front heat-conducting fin portion.

In one embodiment, a plurality of heat-dissipating pipe portions may be coupled to the rear heat-conducting fin portion.

In one embodiment, the heat pipe assembly may further include a heat-insulating member spaced apart from the heat-conducting fin and surrounding the connecting pipe portion.

In one embodiment, the heat pipe assembly may further include a fixing member for fixing the heat pipe to the heat-conducting fin.

Technical Effect

According to the embodiment of the present disclosure, a heat transferring ability of the heat pipe is increased by the heat-conducting fin, which may increase a power consumption reduction effect by the heat pipe.

Further, the manufacturer may minimize a cost of an entire plant for manufacturing each of two models sharing the evaporator of a dehumidifier model having the heat pipe assembly and the evaporator installed together therein and a dehumidifier model without the heat pipe assembly.

In addition, rapid dehumidification may be performed while minimizing a flow path resistance of the air flowing in front of and behind the evaporator.

DETAILED DESCRIPTIONS

Hereinafter, a specific embodiment of the present disclosure will be described in detail with reference to drawings.

Figure 1:
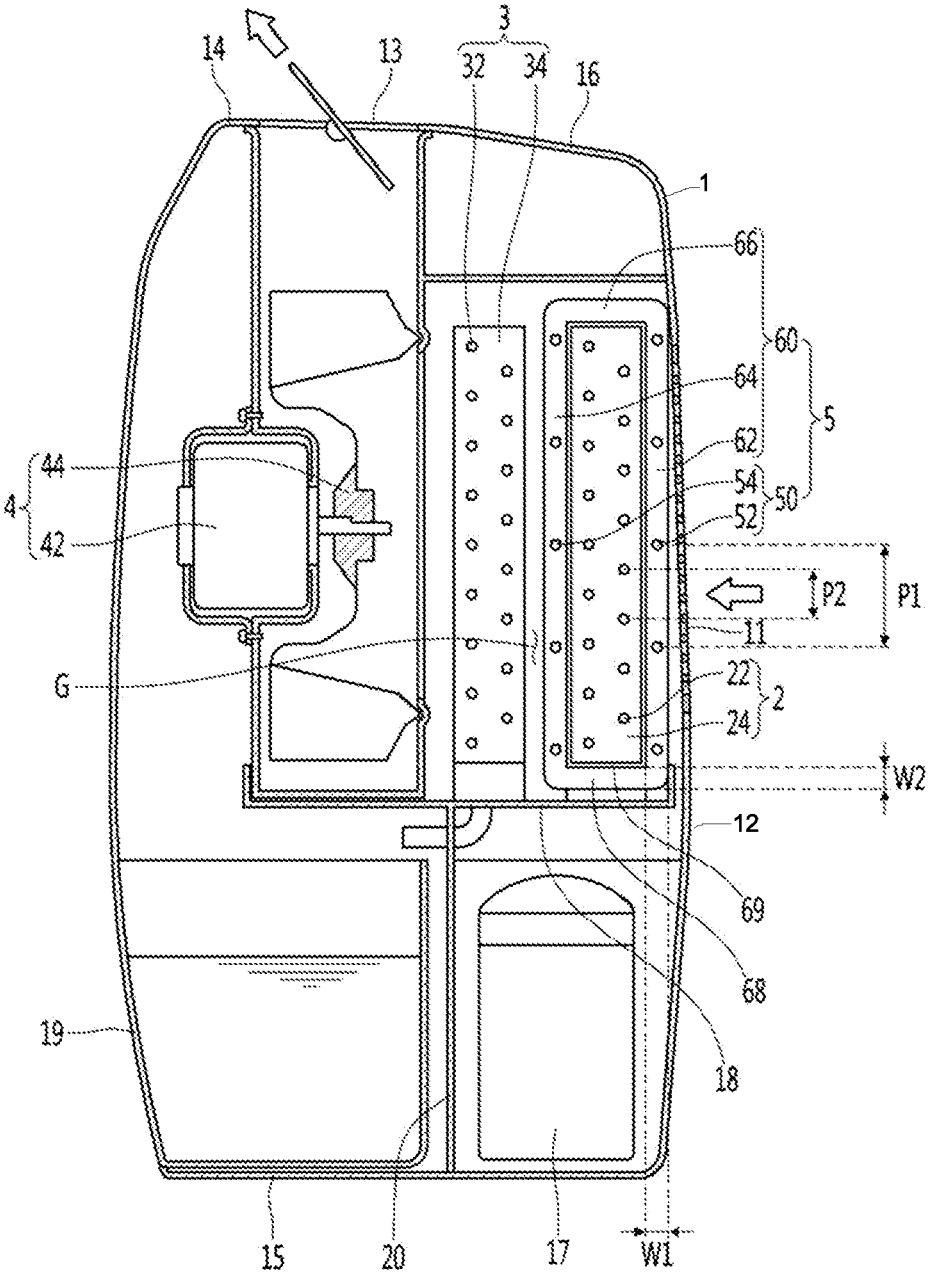
FIG. 1 is a longitudinal sectional view of a dehumidifier according to an embodiment of the present disclosure.
Figure 2:
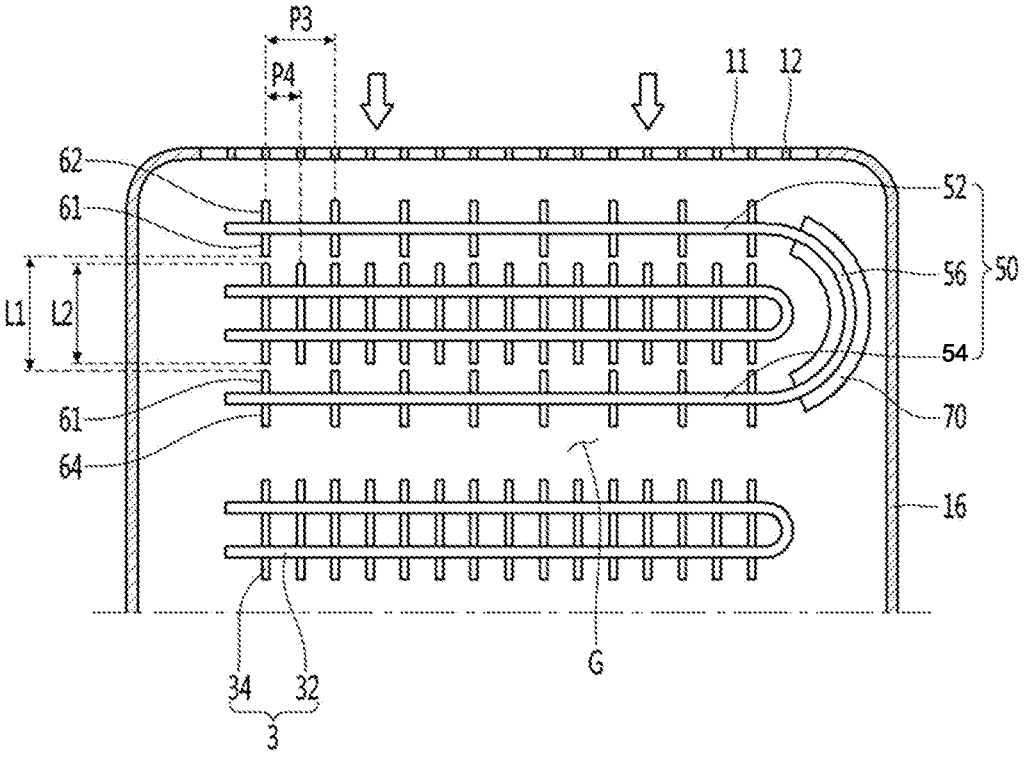
FIG. 2 is a cross-sectional view of a dehumidifier according to an embodiment of the present disclosure.

FIG. 1 is a longitudinal sectional view of a dehumidifier according to an embodiment of the present disclosure. Further, FIG. 2 is a cross-sectional view of a dehumidifier according to an embodiment of the present disclosure.

A dehumidifier of the present embodiment includes a case 1, an evaporator 2, a condenser 3, a fan 4, and at least one heat pipe assembly 5.

The case 1 may include a suction body 12 having an air intake opening 11 defined therein. The case 1 may include a discharge body 14 having an air discharge opening 13 defined therein. The case 1 may include a base 15 that forms an outer face of a bottom of the dehumidifier. The case 1 may further include an outer cover 16 that covers both side-faces of the evaporator 2.

The suction body 12 may be disposed to face the heat pipe assembly 5.

The dehumidifier may include: a compressor 17 for compressing a refrigerant; a drain pan 18 for receiving therein condensate water dropped from the evaporator 2 or the heat pipe assembly 5; and a water container 19 in which the condensate water dropped to the drain pan 18 is collected.

The compressor 17, the drain pan 18, and the water container 19 may be arranged inside the case 1. A barrier 20 that divides an interior of the case 1 into a compressor receiving space in which the compressor 17 is received and a water container receiving space in which the water container 19 is disposed may be disposed in the case 1. The drain pan 18 may be disposed on the barrier 20.

The evaporator 2 may be disposed inside the case 1. In the evaporator 2, an evaporating fin 24 may be coupled to at least one evaporating tube 22.

The condenser 3 may be disposed inside the case 1. The condenser 3 may be spaced apart from the evaporator 2. A gap G in which a portion of the heat pipe assembly 5 may be received may be defined between the condenser 3 and the evaporator 2.

The fan 4 may flow an air from the evaporator 2 to the condenser 3. The fan 4 may include a motor 42 and an impeller 44 connected to the motor 42 and rotated.

The at least one heat pipe assembly 5 may be positioned in front of and behind the evaporator 2 in a flow direction of the air.

The heat pipe assembly 5 may include a heat pipe 50 and a heat-conducting fin 60.

The heat pipe 50 may include a heat-absorbing pipe portion 52, a heat-dissipating pipe portion 54, and a connecting pipe portion 56.

The heat-absorbing pipe portion 52 may be positioned in front of the evaporator 2 in the flow direction of the air. The heat-absorbing pipe portion 52 may be positioned between the air intake opening 11 and the evaporator 2 and pre-cool the air flowing toward the evaporator 2 after passing through the air intake opening 11.

The heat-absorbing pipe portion 52 may be spaced apart from the evaporating tube 22 and the evaporating fin 24 constituting the evaporator 2. The heat-absorbing pipe portion 52 may be spaced apart from each of both ends of the evaporating fin 24 in the flow direction of the air.

The heat-dissipating pipe portion 54 may be positioned between the evaporator 2 and the condenser 3 in the flow direction of the air. The heat-dissipating pipe portion 54 may be positioned behind the evaporator 2 in the flow direction of the air and may heat the air cooled and dehumidified while passing through the evaporator 2.

The heat-dissipating pipe portion 54 may be spaced apart from the evaporating tube 22 and the evaporating fin 24 constituting the evaporator 2. The heat-dissipating pipe portion 54 may be spaced apart from each of the both ends of the evaporating fin 24 in the flow direction of the air.

The connecting pipe portion 56 may connect the heat-absorbing pipe portion 52 and the heat-dissipating pipe portion 54.

The connecting pipe portion 56 connects one end of the heat-absorbing pipe portion 52 and one end of the heat-dissipating pipe portion 54, as shown in FIG. 2. The connecting pipe portion 56 may be formed in a shape of surrounding a side-end of the evaporator 2.

The connecting pipe portion 56 may be positioned next to the evaporator 2 or above the evaporator 2.

The heat-conducting fin 60 may be coupled with at least one of the heat-absorbing pipe portion 52 and the heat-dissipating pipe portion 54. The heat-conducting fin 60 may have a heat pipe coupling hole 61 defined therein to which at least one of the heat-absorbing pipe portion 52 and the heat-dissipating pipe portion 54 is coupled.

The connecting pipe portion 56 may be disposed so as not to be in contact with the evaporating tube 22 and the evaporating fin 24.

Referring to FIG. 1, the evaporating tube 22 may include a plurality of evaporating tubes and the heat pipe 50 may include a plurality of heat pipes. Further, the number of the heat pipes 50 may be smaller than the number of the evaporating tubes 22. Each of the heat pipes 50 and the evaporating tubes 22 may be arranged at regular intervals in a vertical direction. The heat pipes may be arranged such that a pitch P1 of the heat pipes 50 may be larger than a pitch P2 of the evaporating tubes 22.

Since the heat pipe 50 is positioned between the air intake opening 11 and the evaporator 2, the heat pipe 50 may be a resistance in the flow direction of the air.

When the number of the heat pipes 50 is too large and the pitch P1 of the heat pipes 50 is smaller than the pitch P2 of the evaporating tubes 22, a flow path resistance of the air sucked toward the evaporator 2 may be large.

The pitch P1 of the heat pipes 50 is preferably larger than the pitch P2 of the evaporating tube 22 for rapid air flow and rapid dehumidification of a room.

The heat-conducting fin 60 may be spaced apart from the evaporating fin 24. The heat-conducting fin 60 may not be integrally formed with the evaporating fin 24, but may be manufactured separately from the evaporating fin 24.

The heat-conducting fin 60 may be fixed to the heat pipe 50 by a fixing member (not shown) such as an adhesive, brazing, or the like. The heat-conducting fin 60 may be integrated with the heat pipe 50 and may assist in a heat transfer between the air and the heat pipe 50 in a state of being integrated with the heat pipe 50.

The heat-conducting fin 60 may be spaced apart from the evaporating fin 24 in the flow direction of the air and in the vertical direction.

The number of the heat-conducting fins 60 may be smaller than the number of the evaporating fins 24. Each of the heat-conducting fins 60 and the evaporating fins 24 may be arranged at regular intervals in a horizontal direction. The pitch P3 of the heat-conducting fins 60 may be larger than the pitch P4 of the evaporating fins 24.

Since a portion of the heat-conducting fin 60 is positioned between the air intake opening 11 and the evaporating fin 24, the heat-conducting fin 60 may be a resistance in the flow direction of the air.

When the number of the heat-conducting fins 60 is too large and the pitch P3 of the heat-conducting fins 60 is smaller than the pitch P4 of the evaporating fins 24, the flow path resistance of the air sucked toward the evaporator 2 may be large. Thus, the pitch P3 of the heat-conducting fins 60 is preferably larger than the pitch P4 of the evaporating fins 24 for the rapid flow of the air and the rapid dehumidification of the room.

The heat-conducting fin 60 may include at least one front heat-conducting fin portion 62 having a heat pipe coupling hole 61 defined therein to which the heat-absorbing pipe portion 52 is coupled. Further, the heat-conducting fin 60 may include at least one rear heat-conducting fin portion 64 having the heat pipe coupling hole 61 defined therein to which the heat-dissipating pipe portion 54 is coupled.

A distance L1 between a rear-end of the front heat-conducting fin portion 62 and a front-end of the rear heat-conducting fin portion 64 may be larger than a width L2 of the evaporating fin 24 in the flow direction of the air.

The heat-conducting fin 60 may further include a connecting fin portion 66 and 68 connecting the front heat-conducting fin portion 62 and the rear heat-conducting fin portion 64 with each other and integrally formed with the front heat-conducting fin portion 62 and the rear heat-conducting fin portion 64.

The connecting fin portion 66 and 68 may be parallel to the connecting pipe portion 56.

Each width W1 in a front and rear direction of the front heat-conducting fin portion 62 and the rear heat-conducting fin portion 64 may be larger than a width W2 in the vertical direction of the connecting fin portion 66 and 68.

It is preferable that the heat pipe assembly 5 is capable of sufficiently transferring the heat and is as compact as possible. Further, the vertical width W2 of the connecting fin portion 66 and 68 to which the heat pipe 50 is not connected is preferably smaller than the front and rear directional width W1 of the front heat-conducting fin portion 62 to which the heat pipe 50 is connected.

The connecting fin portion 66 and 68 may include an upper fin portion 66 positioned above the evaporator 2 and a lower fin portion 68 positioned below the evaporator 2.

An evaporator inserting space 69 may be defined by the front heat-conducting fin portion 62, the rear heat-conducting fin portion 64, the upper fin portion 66, and the lower fin portion 68.

The evaporator inserting space 69 may be defined to be larger than the heat pipe coupling hole 61. The plurality of heat pipes 50 may be vertically spaced apart from each other. Further, a plurality of heat-absorbing pipe portions 52 may be coupled to the front heat-conducting fin portion 62. Further, a plurality of heat-dissipating pipe portions 54 may be coupled to the rear heat-conducting fin portion 64.

Referring to FIG. 2, the heat pipe assembly may further include a heat-insulating member 70 spaced apart from the heat-conducting fin 60 and surrounding the connecting pipe portion 56. The heat-insulating member 70 may be positioned between the side-end of the evaporator 2 and the outer cover 16.

Figure 3:
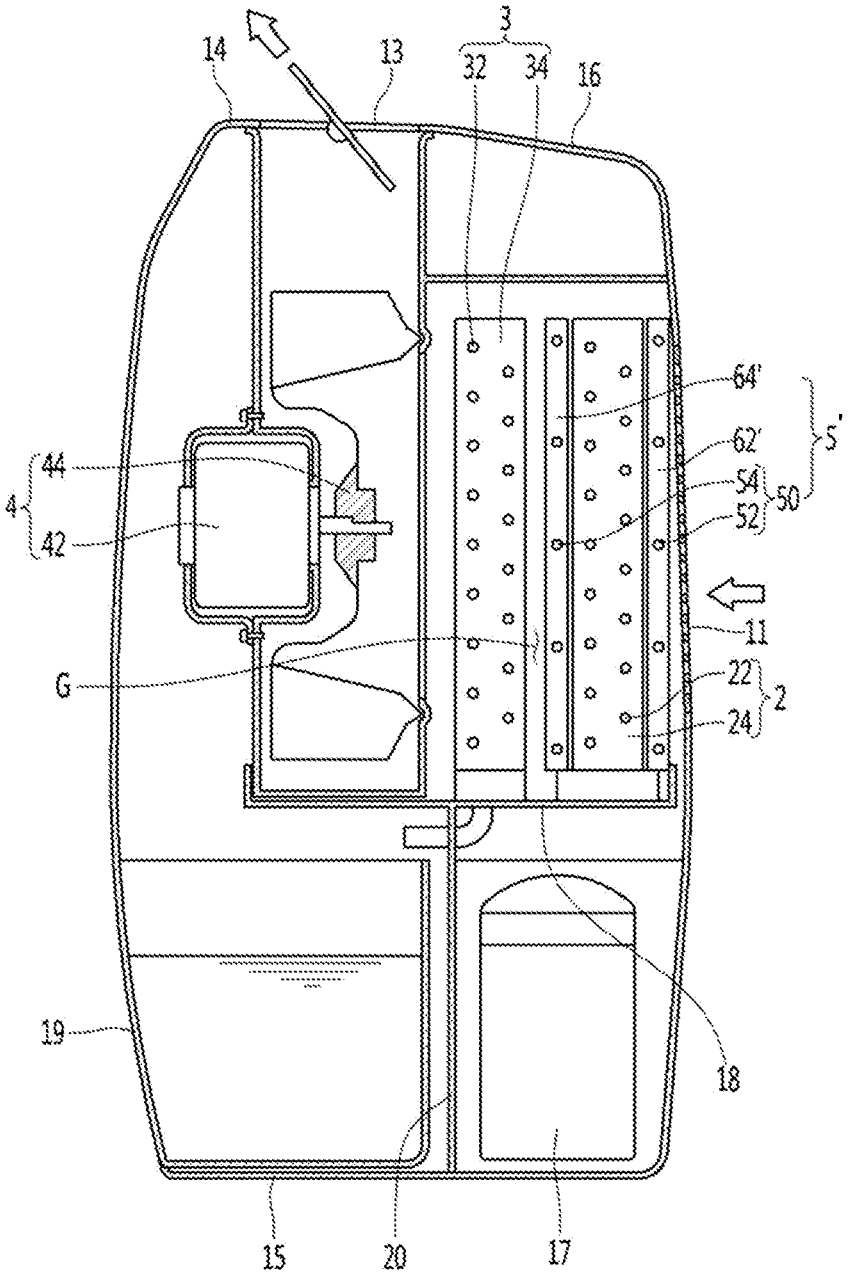
FIG. 3 is a longitudinal sectional view of a dehumidifier according to another embodiment of the present disclosure.

FIG. 3 is a longitudinal sectional view of a dehumidifier according to another embodiment of the present disclosure.

In a heat pipe assembly 5' of the present embodiment, a front heat-conducting fin portion 62' and a rear heat-conducting fin portion 64' may be separated from each other, the plurality of heat pipes 50 may be connected to the front heat-conducting fin portion 62', and the plurality of heat pipes 50 may be connected to the rear heat-conducting fin portion 64'.

In the present embodiment, the single heat pipe assembly 5' may be disposed in the dehumidifier. Such single heat pipe assembly 5' may be composed of the plurality of heat pipes 50, a plurality of front heat-conducting fin portions 62', and a plurality of rear heat-conducting fin portions 64'.

In the present embodiment, other configurations and operations of the front heat-conducting fin portion 62' and the rear heat-conducting fin portion 64' except for a separate structure thereof are the same as or similar to those of one embodiment of the present disclosure. Thus, the same reference numerals are used and a detailed description thereof will be omitted.

In the present embodiment, the number of the front heat-conducting fin portions 62' and the number of the rear heat-conducting fin portions 64' may be different from each other.

In the present embodiment, a location of the front heat-conducting fin portion 62' and a location of the rear heat-conducting fin portion 64' may be different from each other.

For example, one of the front heat-conducting fin portion 62' and the rear heat-conducting fin portion 64' may be disposed to face the evaporating fin 24 and the other of the front heat-conducting fin portion 62' and the rear heat-conducting fin portion 64' may be disposed to face between adjacent evaporating fin 24.

For example one of the front heat-conducting fin portion 62' and the rear heat-conducting fin portion 64' may be disposed to be close to the evaporating fin 24 and the other of the front heat-conducting fin portion 62' and the rear heat-conducting fin portion 64' may be disposed to be further away from the evaporating fin 24.

In the present embodiment, when the number of the heat pipes 50 constituting the heat pipe assembly 5' is L, the number of the front heat-conducting fin portions 62' is N, and the number of the rear heat-conducting fin portions 64' constituting such the heat pipe assembly is M, a ratio of the number of the heat pipes 50, the front heat-conducting fin portions 62', and the rear heat-conducting fin portions 64' constituting the single heat pipe assembly 5' installed in the dehumidifier may be L:N:M.

Figure 4:
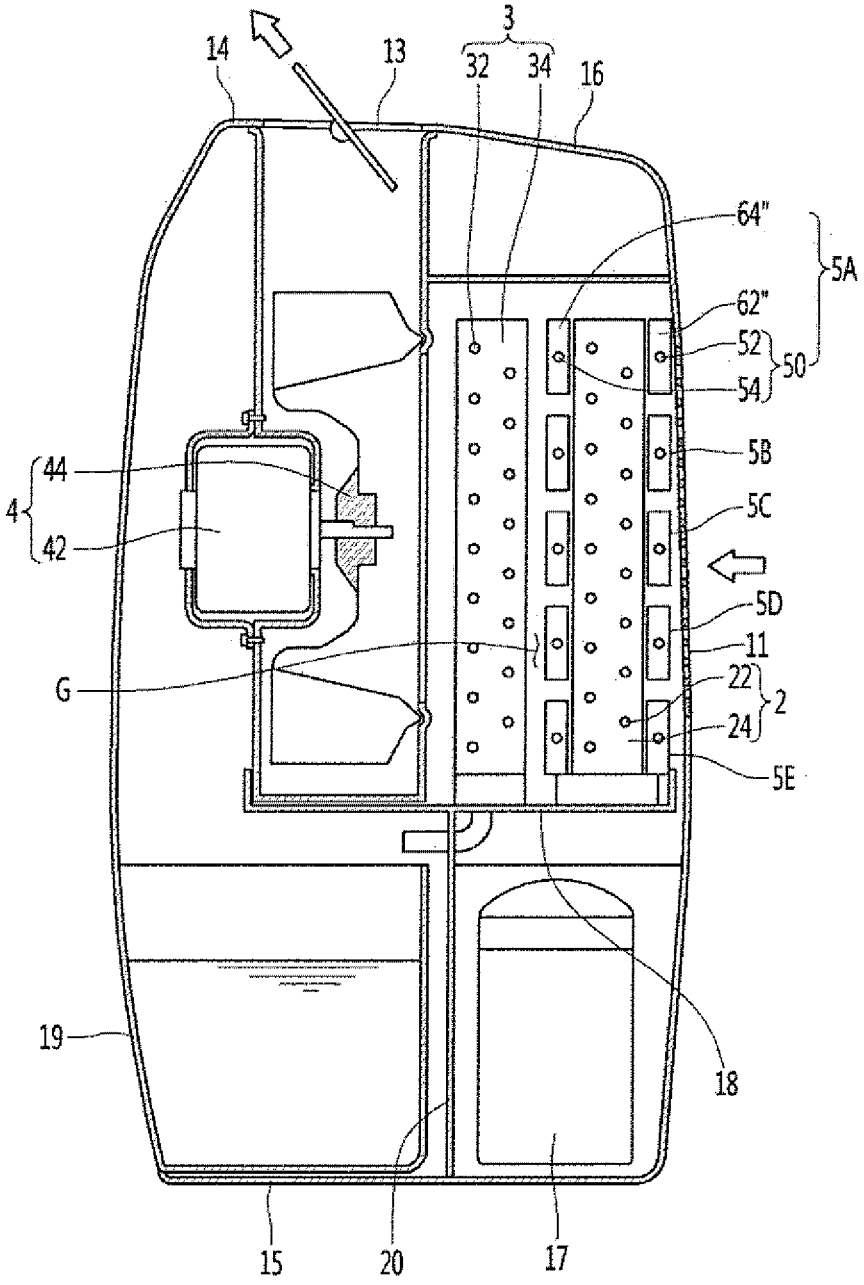
FIG. 4 is a longitudinal sectional view of a dehumidifier according to still another embodiment of the present disclosure.

FIG. 4 is a longitudinal sectional view of a dehumidifier according to still another embodiment of the present disclosure.

As shown in FIG. 4, the present embodiment may include a plurality of heat pipe assemblies 5A, 5B, 5C, 5D, and 5E. In each of the plurality of heat pipe assemblies 5A, 5B, 5C, 5D, and 5E, a front heat-conducting fin portion 62" and a rear heat-conducting fin portion 64" may be separated from each other. Each of the front heat-conducting fin portion 62" and the rear heat-conducting fin portion 64" may be connected to the heat pipe 50.

The front heat-conducting fin portion 62" and the rear heat-conducting fin portion 64" of the present embodiment may differ from each other in the number or a location as in the other embodiment of the present disclosure.

In the present embodiment, the plurality of heat pipe assemblies 5A, 5B, 5C, 5D, and 5E may be arranged to surround a front, a rear, and a side face of the evaporator 2. Such the plurality of heat pipe assemblies 5A, 5B, 5C, 5D, and 5E may be arranged to be spaced apart from each other in the vertical direction.

Each of the heat pipe assemblies 5A, 5B, 5C, 5D, and 5E of the present embodiment may include the heat pipe 50, a plurality of front heat-conducting fin portions 62" connected to the heat-absorbing pipe portion 52 of the heat pipe 50, and at least a plurality of rear heat-conducting fin portions 64" connected to the heat-dissipating pipe portion 54 of the heat pipe 50.

In the present embodiment, when the number of the front heat-conducting fin portions 62" constituting the heat pipe assembly is N and the number of the rear heat-conducting fin portions 64" constituting such the heat pipe assembly is M, a ratio of the number of the heat pipe 50, the front heat-conducting fin portions 62", and the rear heat-conducting fin portions 64" constituting each of the heat pipe assemblies 5A, 5B, 5C, 5D, and 5E may be 1:N:M.

The description above is merely illustrative of the technical idea of the present disclosure, and various modifications and changes may be made by those skilled in the art without departing from the essential characteristics of the present disclosure.

Therefore, the embodiments disclosed in the present disclosure are not intended to limit the technical idea of the present disclosure but to illustrate the present disclosure, and the scope of the technical idea of the present disclosure is not limited by the embodiments.

The scope of the present disclosure should be construed as being covered by the scope of the appended claims, and all technical ideas falling within the scope of the claims should be construed as being included in the scope of the present disclosure.

The invention claimed is:

1. A dehumidifier comprising:

a case including a suction body having an air intake opening defined therein and a discharge body having an air discharge opening defined therein;

an evaporator disposed inside the case, wherein the evaporator includes a plurality of evaporating fins coupled to a plurality of evaporating tubes;

a condenser disposed inside the case, wherein the condenser is spaced apart from the evaporator;

a fan that blows air from the evaporator to the condenser; and a heat pipe assembly positioned in front of and behind the evaporator in a flow direction of air, wherein the heat pipe assembly is spaced apart from the evaporator, and wherein the heat pipe assembly includes:

a plurality of heat pipes, wherein each of the plurality of heat pipes includes a heat-absorbing pipe portion disposed in front of the evaporator in the flow direction of air, a heat-dissipating pipe portion disposed between the evaporator and the condenser in the flow direction of air, and a connecting pipe portion that connects the heat-absorbing pipe portion and the heat-dissipating pipe portion to each other; and a plurality of heat-conducting fins including a plurality of front heat-conducting fin portions having a first heat pipe coupling hole defined therein, and a plurality of rear heat-conducting fin portions having a second heat pipe coupling hole defined therein, wherein the heat-absorbing pipe portion is coupled to the first heat pipe coupling hole, and the heat-dissipating pipe portion is coupled to the second heat pipe coupling hole, wherein the plurality of front heat-conducting fin portions is spaced apart from the plurality of evaporating fins, wherein the plurality of rear heat-conducting fin portions is spaced apart from the plurality of evaporating fins, wherein a number of the plurality of front heat-conducting fin portions is smaller than a number of the plurality of evaporating fins, wherein a number of the plurality of rear heat-conducting fin portions is smaller than the number of the plurality of evaporating fins, and wherein a pitch of the plurality of heat pipes is larger than a pitch of the plurality of evaporating tubes.

2. The dehumidifier of claim 1, wherein a distance between a rear-end of the plurality of front heat-conducting fin portions and a front-end of the plurality of rear heat-conducting fin portions is larger than a width of the plurality of evaporating fins in the flow direction of air.

3. The dehumidifier of claim 1, wherein each of the plurality of heat-conducting fins further includes a connecting fin portion that connects the respective plurality of front heat-conducting fin portions and the respective plurality of rear heat-conducting fin portions with each other.

4. The dehumidifier of claim 3, wherein the connecting fin portion is parallel to the connecting pipe portion.

5. The dehumidifier of claim 3, wherein each of a width in a front and rear direction of the plurality of front heat-conducting fin portions and a width in a front and rear direction of the plurality of rear heat-conducting fin portions is larger than a width in a vertical direction of the connecting fin portion.

6. The dehumidifier of claim 3, wherein the connecting fin portion further includes:

an upper fin portion positioned above the evaporator; and a lower fin portion positioned below the evaporator, and wherein an evaporator inserting space is defined by the plurality of front heat-conducting fin portions, the plurality of rear heat-conducting fin portions, the upper fin portion, and the lower fin portion.

7. The dehumidifier of claim 5, wherein an evaporator inserting space is defined to be larger than the first heat pipe coupling hole and the second heat pipe coupling hole.

8. The dehumidifier of claim 1, wherein the plurality of heat pipes is vertically spaced apart from each other, wherein the plurality of heat-absorbing pipe portions is coupled to the plurality of front heat-conducting fin portions, and wherein the plurality of heat-dissipating pipe portions is coupled to the plurality of rear heat-conducting fin portions.

9. The dehumidifier of claim 1, wherein the heat pipe assembly further includes a heat insulator that is spaced apart from the plurality of heat-conducting fins and surrounds the connecting pipe portion.

10. The dehumidifier of claim 1, wherein the heat pipe of the heat pipe assembly is fixed to the plurality of heat-conducting fins by an adhesive or brazing.

11. The dehumidifier of claim 1, wherein the case further includes a base that forms an outer face of a bottom of the dehumidifier and an outer cover that covers both side faces of the evaporator.

12. The dehumidifier of claim 1, further including a drain pan disposed below the evaporator and the heat pipe assembly that receives condensate water dropped from the evaporator and the heat pipe assembly.

13. The dehumidifier of claim 12, further including a barrier that divides an interior of the case into a compressor receiving space in which a compressor is received and a water container receiving space in which a water container is received.

14. The dehumidifier of claim 13, wherein the drain pan is disposed on the barrier.

15. The dehumidifier of claim 14, wherein the condensate water dropped in the drain pan is collected in the water container.

16. The dehumidifier of claim 1, wherein the connecting pipe portion is shaped to surround a side end of the evaporator.

17. The dehumidifier of claim 16, wherein the connecting pipe portion is spaced apart from the side end of the evaporator.

18. The dehumidifier of claim 1, wherein each of the plurality of heat pipes and the plurality of evaporating tubes is arranged at a regular interval in a vertical direction.

19. The dehumidifier of claim 1, wherein the fan includes a motor and an impeller coupled to the motor and rotated by the motor.

* * * * *